US007163415B2

(12) United States Patent
Miyoshi

(10) Patent No.: US 7,163,415 B2
(45) Date of Patent: Jan. 16, 2007

(54) CONNECTOR STRUCTURE

(75) Inventor: Osamu Miyoshi, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/055,303

(22) Filed: Feb. 9, 2005

(65) Prior Publication Data

US 2005/0272298 A1 Dec. 8, 2005

(30) Foreign Application Priority Data

Jun. 8, 2004 (JP) ..... 2004-169354

(51) Int. Cl.
*H01R 4/24* (2006.01)

(52) U.S. Cl. ..... 439/404; 439/862

(58) Field of Classification Search ..... 439/400, 439/404, 405, 289, 417, 598, 398, 687, 862
See application file for complete search history.

(56) References Cited

U.S. PATENT DOCUMENTS 4,354,719 A * 10/1982 Weidler ..... 439/598
4,545,635 A * 10/1985 Bunnell ..... 439/404
4,674,819 A * 6/1987 Fujitani et al. ..... 439/404
5,762,513 A * 6/1998 Stine ..... 439/358
6,328,592 B1 * 12/2001 Burke et al. ..... 439/417

* cited by examiner

*Primary Examiner*—Phuong Dinh
(74) *Attorney, Agent, or Firm*—Darby & Darby

(57) ABSTRACT

A contact construction requiring minimum space above a connector allowing installation of a connection cable on a circuit board in a layout direction of contacts that provides increased freedom in wiring/board design. A bottom surface of the housing forms a mounting surface of the circuit board while a top surface forms a cable layout surface for laying out the connection cable in the surface direction of the circuit board. A bottom end of a terminal in the housing protrudes toward the circuit board side to form a contact part to connect with the circuit board, and the top end forms a connection part to connect with the connection cable. A plurality of terminals is provided in a row in the housing, a plurality of wires is laid out on the cable layout surface in the circuit board direction, ensuring each connection cable is electrically connected to the desired terminal.

15 Claims, 5 Drawing Sheets

Fig. 1(g)
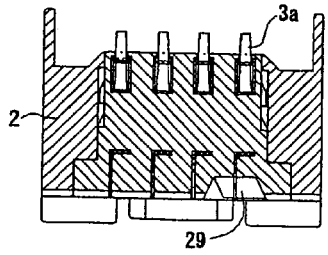
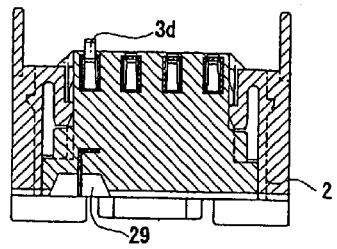
Fig. 1(h)
Fig. 1(f)
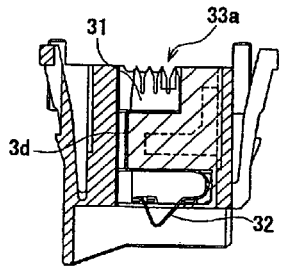
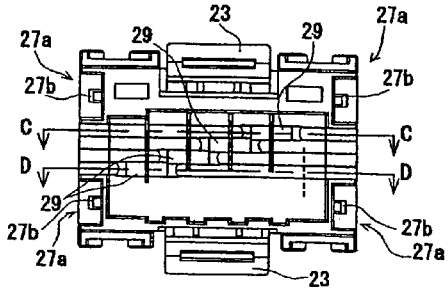
Fig. 1(d)
Fig. 1(e)
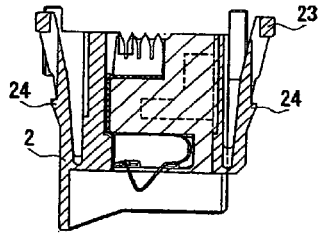
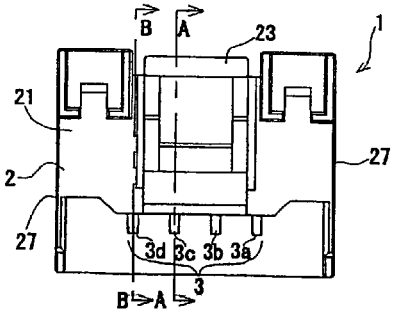
Fig. 1(a)
Fig. 1(c)
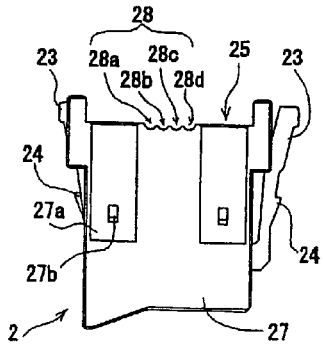
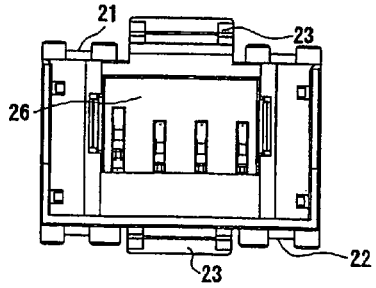
Fig. 1(b)

CONNECTOR STRUCTURE

INCORPORATION BY REFERENCE

The present application claims priority under 35 U.S.C. §119 to Japanese Patent Application No. 2004-169354 filed on Jun. 8, 2004. The content of the application is incorporated herein by reference in its entirety.

1. Field of the Invention

The invention relates to a connector that electrically connects with a circuit board, more specifically, a connector that electrically connects a group of cables consisting of a plurality of cables or a flat cable with another member.

2. Description of the Related Art

Crimping connectors and insulation displacement connectors ("IDC") are widely used. For example, IDC such as the one shown in FIG. 6 have been widely used in the inside of electronic equipment.

An insulation displacement connector ("IDC") 100 shown in FIG. 6 is a connector plug, wherein connection terminals 101 provided on the insulation connector 100 fit with connector pins 112 when the connector plug fit with a plurality of connection pins 112 provided on a connector socket 111, which is in turn provided on a circuit board 110, thus causing the IDC 100 to be inserted into the connector socket 111 and the connection cable 120 to be electrically connected with corresponding connection pins 112. Since each connection pin 112 is electrically connected with the wiring pattern of the circuit board, the connection cable 120 is thus electrically connected to specified positions of the circuit board.

A problem with connectors of prior art for electrically connection cables with wiring patterns of circuit boards is that the direction of insertion of the connection cables into the connector socket is perpendicular to the circuit board. In other words, the insertion direction for the connector to be mounted on the circuit board is identical to the direction of pulling out the connection cable from the connector. As a consequence, the connection cable is bent or twisted when it is connected to a circuit board in a device, which presents a problem that it is difficult to route the connection cable when there is not enough space above the circuit board to which the connectors are to be connected. There are also problems that damages tend to occur on the outer skin of the connection cables or on the conductors themselves if the connection cables are used for prolonged periods of times maintaining sharp bends.

In case of routing the connection cables as described above, the connection cables have to be bent almost perpendicularly in parallel with the circuit board as shown in FIG. 7, if in case the cables are to be placed in the same direction as the layout direction of the circuit board pattern (i.e., the layout direction of the connection cables is perpendicular to the circuit board layout pattern), so that it presents not only a problem that the burden on the connection cables increases due to the bending but also a problem that the connection cables cannot be laid out smartly as the connection cables on both ends having different actual layout route lengths despite the fact that all connection cables have the same length.

SUMMARY OF THE INVENTION

The invention provides a connector for electrically connecting connection cables with other members such as circuit boards or other devices eliminating those problems mentioned above.

The invention provides a connector having a terminal, one end of which forms a connection part for electrically connecting with a connection cable and at least another part of which forms a conducting part for electrically conducting with another member and a housing having internally a plurality of terminals in such a way that the connection parts of the terminals are located on one side of the housing, the conducting parts of the terminals are located on the other side of the housing, and a side on which the connection parts of the terminals are located forms a cable carrying surface. A plurality of connection cables are provided to intersect multiple terminals' connection parts that are arranged in a row. Each connection cable is electrically connected with desired terminals by means of crimping or insulation displacement connection (IDC).

Therefore, in case of said connector, the connection cables that are connected to the connector extend in parallel with the circuit board surface. Moreover, a plurality of cables such as in the case of a flat cable is laid crosswise relative to a plurality of connection positions in order to electrically connect desired cables among the cables laid crosswise with desired connection. This transmits electrical signals from each desired cable to each desired terminal of the contact part, so that it is possible to arrange the signal pattern freely from each cable obtained from the contact part without rearranging the cable positions.

It is also possible to obtain a desired signal or signals at a plurality of positions without bending the flat cable by arbitrarily selecting the connection parts to be connected with the cables in case when it is desired to obtain the same signal available from the flat cable running a long distance in a same or different pattern at a plurality of locations or when it is desired to obtain only the signal from a desired cable at a plurality of locations.

Moreover, the invention provides a connector having a terminal. One end of the terminal forms a connection part for electrically connecting with a connection cable and at least another part of which forms a contact part for connecting with a circuit board. A housing has, internally, a plurality of terminals arranged so that the connection parts of the terminals are located on one side of the housing. The contact parts of the terminals are located on the other side of the housing, a side the contact parts are located forms a parts mounting surface of a circuit board, and a side the connection parts of the terminals are located forms a cable carrying surface. A plurality of connection cables are provided to intersect multiple terminals' connection parts that are arranged in a row and each connection cable is electrically connected with desired terminals by means of crimping or insulation displacement connection (IDC).

According to said connector, some parts of the terminal constitutes contact parts so that it is possible to transmit the signal from the desired cable to the desired point(s) for connection with the circuit board in accordance with the connecting pattern.

In all of the connectors mentioned above, each terminal's connection parts installed in a row in the housing extend in a direction intersecting the direction of said installation of terminals. This forms a plurality of connection points, so that a plurality of terminals is arranged in parallel with the lengthwise direction of the connection cable laid on the cable carrying surface and the connection points of each terminal extend in a direction intersecting the lengthwise direction of the connection cable laid on the cable carrying surface. Therefore, the connection cable laid out in such a fashion is lying crosswise over a plurality of terminals, and is electrically connected at connection points either by crimping or IDC at the connection points of the desired terminals.

Moreover, the connector is constituted in such a way that a side of the housing the connection parts are located from the cable carrying surface. The cable carrying surface having a plurality of cable carrying grooves provided in a row along the cable carrying direction. A connection cavity is provided in a concave shape in the cable carrying groove for connecting the connection cable with the connection part. The connection cavity causes the connection part of the terminal to be exposed to enable the connection part to be connected with the connection cable. The connection points of the terminal are located at the connection cavity are exposed by having a connection cavity provided deeper than the cable carrying groove on the cable carrying surface of the housing. The connection cable laid along the cable carrying grooves connects with the exposed connection points of the terminal in the connection cavities, so that other connection points of other terminals do not interfere with said connection cable. Also, by extending the connection points of said terminal extending in the direction in a direction intersecting the lengthwise direction of the connection cable laid on the cable carrying surface, the avoidance of said interference is made further secure.

Moreover, the housing of the connector further includes a housing cover capable of latching with the housing so that the cable carrying surface can be covered, and has an insulation displacement connection (IDC) protrusion formed on a side that faces the cable carrying surface at a location where a desired cable and a desired connection part are to be connected. The desired cable is pressed to be connected electrically with the desired connection part when the housing is latched. A housing cover can consist of a cover main body that can be latched with the housing to cover the cable carrying surface of the housing and a spacer to be located over the cables at points where desired cables are connected with their respective desired connection parts. The housing cover electrically connects only the desired cables with the desired connection parts by the pressure exerted by the spacer when the cover main body is latched with the housing.

The housing cover can be constituted in such a way as to have convex IDC (insulation displacement connection) protrusions formed in advance at locations where the cables and the connection parts that are to be connected intersect with each other on the cable carrying surface of the housing, or to have IDC protrusions formed between the housing cover and the cable carrying surface by having a separate spacer at the intersecting positions. As the housing cover latches with the housing under such a condition, each connection cable will be crimped or insulation displacement connected with desired terminals to achieve electrical connection.

The invention makes it possible to arrange freely the pattern of signals obtained from each cable without rearranging the positions of the cables, as the cables such as flat cables are laid crosswise relative to the connection positions and only the desired cables among all the cables laid crosswise are electrically connected with the desired connection parts thus transmitting electrical signals from each desired cable to each desired terminal of the contact part.

Moreover, the invention makes it possible to obtain same signals on a plurality of locations with the same or different patterns from a flat cable running a long distance as it is possible to obtain desired signals at desired points without having to bend the flat cable by properly selecting the connection parts of the terminals to be connected with the cable. Similarly, the invention makes it possible to obtain a plurality of desired signals at desired locations without bending the flat cable by properly selecting the connection parts of the terminals to be connected with the cable. It is possible to obtain only the signals from the desired cable at a plurality of locations. Furthermore, the invention makes it possible to achieve a high degree of freedom in laying out connection points on devices such as circuit boards and terminals can be installed at any locations of a connection cable which is required to be installed for a long distance without cutting the connection cable in the middle. It is also possible to install terminals at arbitrary positions.

Moreover, the invention makes it possible to install connection cables in a limited space since the connection cable laid out on the cable carrying groove of the connector is positioned parallel to the circuit board and consequently does not require any extra space above the connector. Since the connection cable does not extend in the normal direction of the circuit board from the connector, there is no need to bend or twist the cable so that a connection cable such as a flat cable can be installed on a circuit board in a compact manner.

Since the connection parts of a terminal are arranged in an intersecting direction relative to the terminal layout direction, it is possible to lay out the connection cable in the direction of the row of the contact points, to which the contact parts of each terminal are connected. It is possible to achieve a higher degree of freedom in routing the connection cables and a high degree of freedom in designing the circuit board.

Moreover, if the contact part is formed in a bent or twisted spring shape in order to press itself against the circuit board to maintain a contact pressure by means of the spring force, the spring span of the contact part can be designed to have at least the length of the connection point, so that a sufficient spring force can be achieved.

Moreover, the invention simplifies the connection process of the connection cables as the need for checking connection errors. Connection positions can be eliminated as a result of providing the connection cavity in the cable carrying surface of the housing and exposing the terminal only where the connection cavity is provided. This allows the connection cable laid on the cable carrying groove of the cable carrying surface to be connected only with the connection parts located in the connection cavity.

Moreover, the invention makes it possible to simplify the connection works between the cables and terminals by providing a housing cover with IDC protrusions formed at specified locations on the cable carrying side of the housing. This causes the cover to latch with the housing and electrically connect the desired cables and the desired terminals by means of crimping or IDC. Similarly, as the housing cover consists of the cover main body and the spacers and the cover can be latched with the housing after the spacers are placed on the desired connection parts and the desired cables, the invention makes it possible not only to connect the desired cables with the desired connection parts more easily, but also to simplify the works further, providing a wider range of applications for the process and making it easier to use individual parts by means of automating the process of placing the spacers in desired positions in the combination of the cover main body and the spacers.

INDUSTRIAL APPLICATION

The contact according to the present invention with the constitutions as described above can be used as the contact for all kinds of printed circuit board surface mounting.

BRIEF DESCRIPTION OF THE DRAWINGS

FIG. 1(*a*) shoes a front description view of the connector according to the invention;

FIG. 1(*b*) shows a bottom description view of the present invention;

FIG. 1(*c*) illustrates left side description view of the embodiment of the present invention;

FIG. 1(*d*) illustrates a plan description view of the present invention;

FIG. 1(*e*) is a view of line A—A which is a cross-sectional description view;

FIG. 1(*f*) is a view of line B—B description view;

FIG. 1(*g*) is a view of line C—C description view;

FIG. 1(*h*) is a view of line D—D description view;

FIG. 2(*b*) shows a right side description view;

FIG. 2(*c*) shows a plan description view of the embodiment;

FIG. 2(*d*) shows a bottom description view

FIG. 2(*e*) is a view of line B—B which is a cross-sectional description view;

FIG. 3(*b*) illustrates a bottom description view

FIG. 3(*c*) shows a left side description view;

FIG. 3(*d*) illustrates a plan description view;

FIG. 3(*e*) is a view of line F—F which is a cross-sectional description view;

DETAILED DESCRIPTION OF THE INVENTION

Terminals are provided in a row as desired. On the upper end of each terminal arranged in a row, a connection part having a plurality of connection points is formed. Consequently, the connection parts of each terminal are arranged in a parallel array. In the meanwhile, on the lower end of each terminal, a contact part is formed for electrically connecting the terminal with the circuit pattern of the circuit board by contacting the contact points provided on the circuit board. A plurality of contact parts are also arranged in a row.

The connector housing contains a plurality of these terminals constituted as described above. As these terminals are affixed inside the housing. Contact parts of each terminal are protruding downward on the parts-mounting surface of the housing, which is the bottom surface of the connector, and the contact parts of the terminals are located on the cable carrying side, which is the upper surface of the housing.

The cable carrying surface, i.e., the upper surface of the housing, is provided with cable carrying grooves provided on the top of the connection parts of each terminal. The cable carrying grooves are proved along the direction each terminal connection part and are provided from end to end of the cable carrying surface. Therefore, said cable carrying grooves are provided along the cable carrying surface from end to end passing through the top of the connection parts of all the terminals. Since a plurality of the cable carrying grooves is provided as such, the cable carrying grooves are provided through the top side of the connection points of all the terminals.

Furthermore, connection cavities are provided at specified places in the cable carrying grooves provided in the housing. The connection cavities are provided in the terminal positions of the cable carrying grooves where it is desired to be connected with the connection cable, i.e., connection point positions, in order to expose the desired connection points on the cable carrying surface. As the connection cavities are provided for a specific desired terminal for each cable carrying groove, so that each connection cable can be connected with the desired terminals.

EXAMPLE 1

Figure 2C:
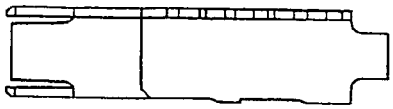
FIG. 2(*a*) illustrates a front description view of the terminal according to the invention.
Figure 2E:
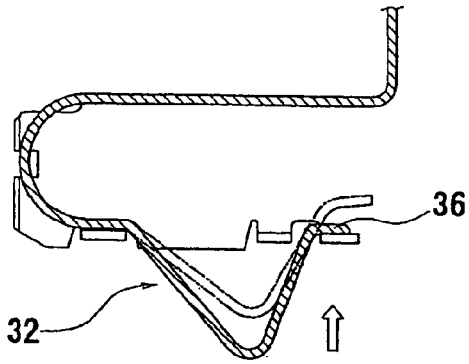
Figure 2A:
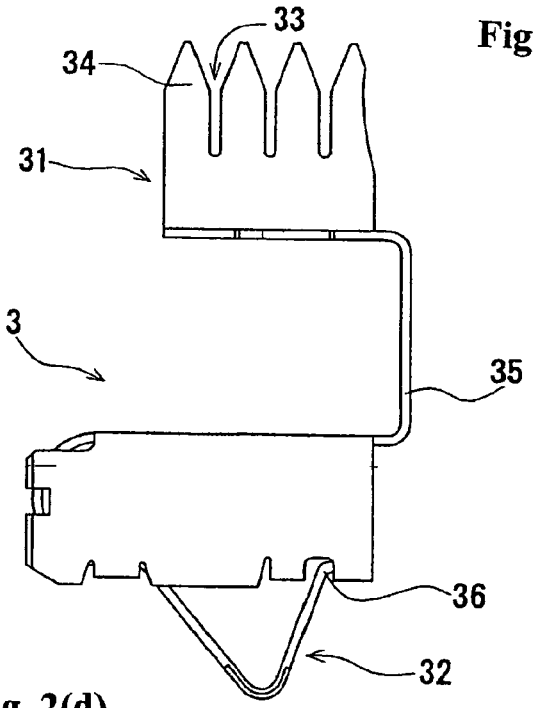
Figure 2B:
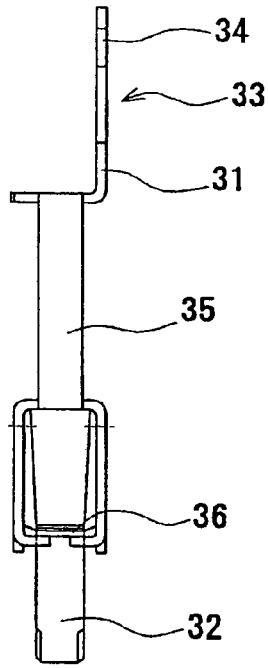
Figure 2B:
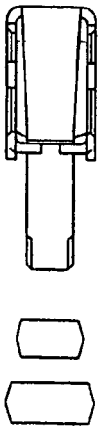
Figure 2D:
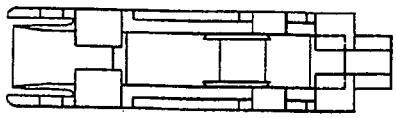
Figure 2D:
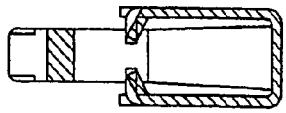
Figure 3D:
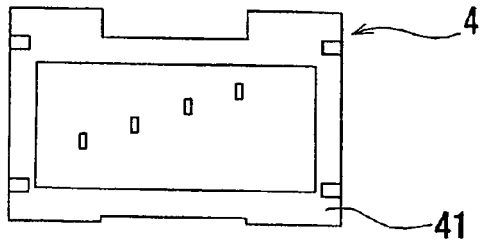
FIG. 3(*a*) shows a front description view of the housing cover.
Figure 3E:
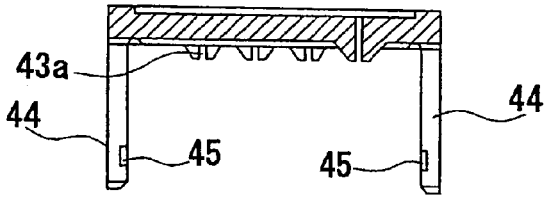
Figure 3C:
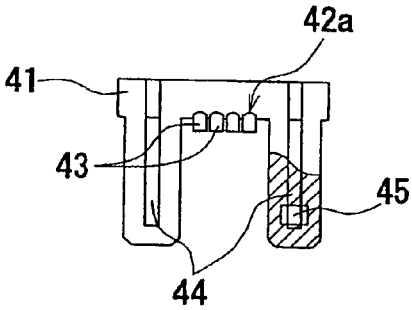
Figure 3A:
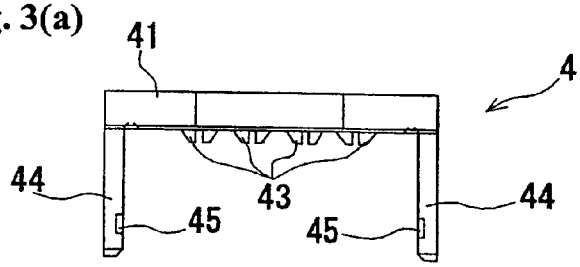
Figure 3B:
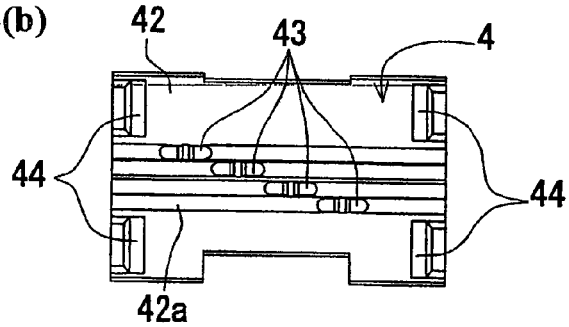
Figure 4:
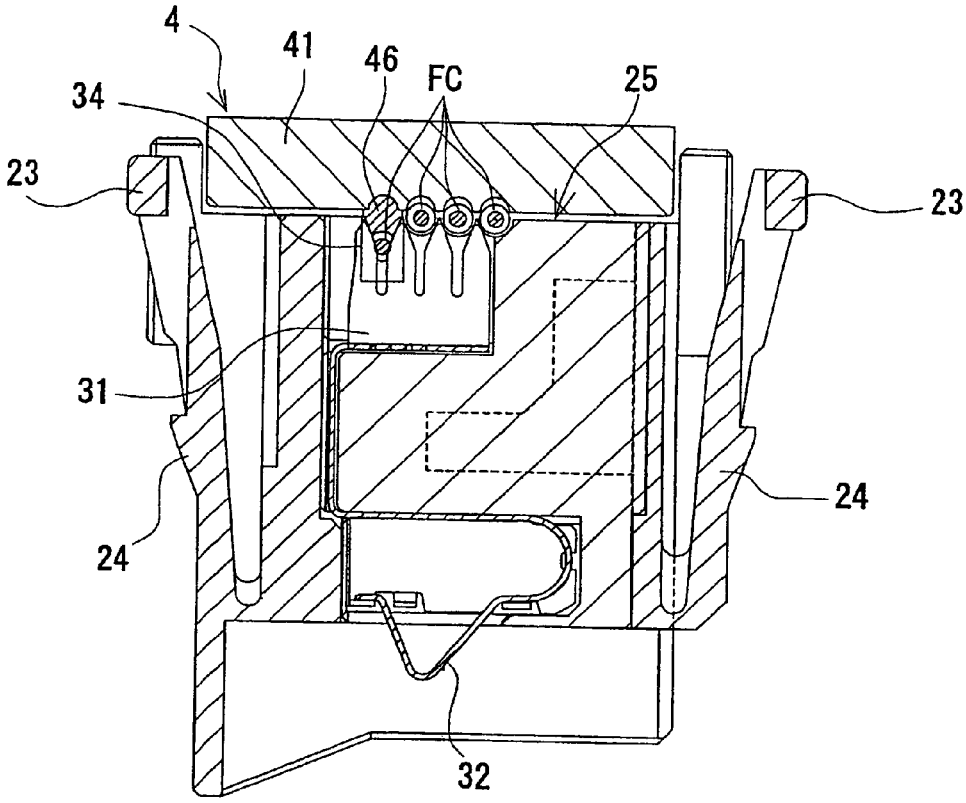
FIG. 4 is a cross-sectional description view of the embodiment of FIG. 3.
Figure 5:
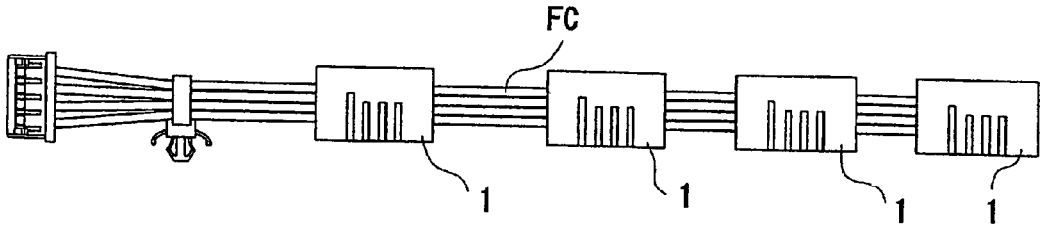
FIG. 5 is a description view of a connection example of connectors and a cable.
Figure 6:
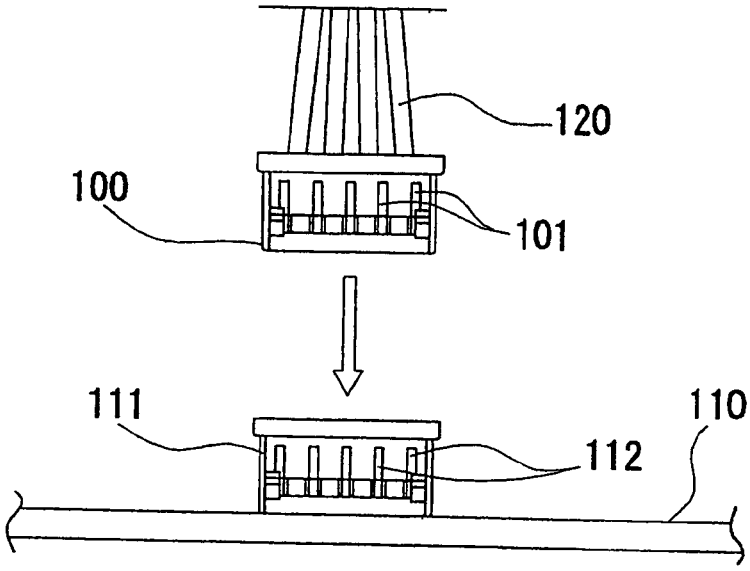
Fig. 6 PRIOR ART
FIG. 6 is a description view of a prior art.
Figure 7:
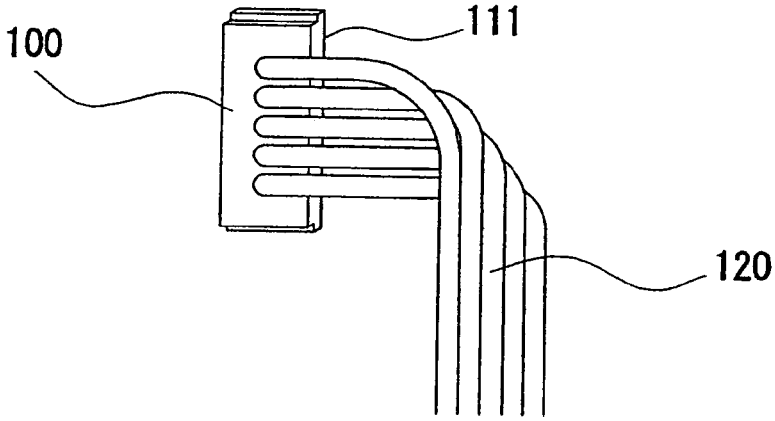
Fig. 7 PRIOR ART
FIG. 7 is a plan view of the prior art.

A preferred embodiment of the invention will be described in the following referring to the accompanying drawings. FIG. 1 shows a connector according to the invention, where (a) is a front description view of the connector according to the invention, (b) is its bottom description view, (c) is its left side description view, (d) is its plan description view, (e) is an A—A cross-sectional description view, (f) is a B—B description view, (g) is a C—C description view, and (h) is a D—D description view. FIG. 2 shows the connector's terminal according to the invention, where (a) is a front description view of the terminal according to the invention, (b) is its right side description view, (c) is its plan description view, (d) is its bottom description view, and (e) is a B—B cross-sectional description view. FIG. 3 shows the connector's cover according to the invention, where (a) shows a front description view of the housing cover, (b) is its bottom description view, (c) is its left side description view, (d) is its plan description view, and (e) is an F—F cross-sectional description view. FIG. 4 is a cross-sectional description view of another example of housing cover. FIG. 5 is a description view of a connection example of connectors and a cable.

The numeral 1 denotes a connector of the invention. The connector 1 electrically connects the connection cable FC laid on the top surface of the connector with a contact part (not shown) provided and exposed on the circuit board comprising a housing 2 that forms the entirety of the contact 1. Terminals 3 connect the connection cable FC with the circuit on the circuit board by means of having one end that connects with the connection cable FC and another end that contacts with a contact part of the circuit board, and a housing cover 4 that covers a top surface 25 of the housing 2 as shown in FIG. 1.

The housing 2 of the connector 1, as shown in FIGS. 1(*a*)–1(*g*), contains a plurality of terminals 3 that are arranged in a row in one direction, and also latching pieces 23, which are free at one end and fixed at another end to the front side 21 and the back side 22 respectively. Latching pieces 23 allow the housing 2 to be locked by engaging latching protrusions 24 provided in the middle. Moreover, cable grooves 28 are provided on a top surface 25, which is the cable carrying surface, to support the connection cable FC between the two sides 27 and 27. Cover latching grooves 27*a* are provided on the side 27 from the top surface 25 to the bottom surface 26. Also, latching stubs 27*b* are provided at the bottom 26 of the cover latching grooves 27*a*. As shown in FIG. 1(*c*), cover latching grooves 27*a* are provided on both sides of this side view, so that legs 44 of the housing cover 4 can be inserted from the top surface 25, and the legs 44 latch with the latching stubs 27*b* to affix the housing 2.

The terminal 3 contained in the housing 2 consists of a first terminal 3*a*, a second terminal 3*b*, a third terminal 3*c*, and a fourth terminal 3*d* as shown from left to right in the front view. Each terminal contained in the housing 2 forms a connection part 31 at one end, which is shown in the upper end in the drawing and connects electrically with the connection cable FC, and a contact part 32 at the other end, which is shown in the lower end and connects electrically with the circuit pattern of the circuit board, while the housing 2 locates the connection part 31 of the terminal 3 on the upper surface 25 and exposes the contact part 32 outside of the bottom surface 26.

Although the connector 1 pressures the contact part 32 of the terminal 3 against the circuit board and accomplishes the electrical connection of the terminal 3 with the circuit board with the help of the spring force of the contact part 32, the connector 1 can be applied for electrical connections with other types of electronic components, members or devices by other means, other than the connection with the circuit board using the contact part 32. For example, connector 1 can be electrically connected by providing a soldering connection part or a connection part consisting of pin-like contacts that can be inserted into sockets mounted on the circuit board instead of the contact part 32 of the terminal 3. In other words, the connector 1 can be used for any electrical connector using the terminals as described here with any devices or components other than the circuit board by means of soldering or other arbitrary means of electrical connections, in addition to surface mounting on a circuit board by means of pressure connection with the circuit board.

Although four terminals 3 are provided in a row on the housing 2 in this embodiment, the invention is applicable to cases where less than three terminals 3 or more than five terminals 3 are installed by simply providing a desired number of terminals 3 in the housing 2 to suit the designed circuit. Moreover, although the external shape of the housing 2 is constructed in this embodiment to have socket-like latching parts (not shown) that are caused to latch with the latching protrusions 24 by the latching pieces 23, it is also possible to use a different method of locking the housing 2 suitable for the circuit that the invention is to be applied.

As shown in FIG. 2, the terminal 3 is made by forming a electrically conductive metallic plate by a stamping process and the connection part 31, which is the upper end, is provided with a connection point 34 having three slits 33 formed to open upward. The connection cable FC is force fitted into the slits 33, causing the slits 33 to puncture the outer skin of the connection cable FC, thus making electrical connections between the conductors and the connection point 34. Although the number of connection points 34 is three in this embodiment, it can be arbitrarily changed depending on the number of connection cables FC to be used. The middle part of the terminal 3 has no restriction to its shape and can be arbitrarily chosen depending on the shape of the housing 2 in which it is enclosed.

A contact part 32 is formed in the lower part of the terminal 3 as shown in FIG. 2(*a*) for electrically connecting the connection cable FC connected to the connection point 34 and the circuit board. The contact part 32 is formed in a triangle protruding downward in the drawing and is constituted in such a way that the contact sprint pressure of the contact part 32 required for making an electrical connection is generated as the contact part 32 makes a contact with the circuit board. This causes its free end 36 to swing around the other end and upward as shown by the arrow.

The terminal 3 comprising the first terminal 3*a* through the fourth terminal 3*d* as described in the above and provided in the housing 2.

In other words, the first terminal 3*a* through the fourth terminal 3*d* are arranged in a row as shown in various subsidiary drawings of FIG. 1. The first terminal 3*a* through the third terminal 3*c*, in particular, are fixed keeping their connection parts 31 and their contact parts 32 in a row as shown in FIGS. 1(*a*) and (*d*). The fourth terminal 3*d* is fixed with it connection part 31 and its slit 33 by offsetting one pitch width in relation with the first terminal 3*a* through the third terminal 3*c*. By offsetting the fourth terminal 3*d* by one pitch width of the slit 33 in relation with the first terminal 3*a* through the third terminal 3*c*, the first slit 33*a* located on the end of the fourth terminal 3*d* turns out to be offset by one pitch of the slit 33 from the connection point 34 of the first slit 33*a* located on the end of the fourth terminal 3*d*. Therefore, by positioning the fourth terminal 3*d* offset from others, it is possible to provide the cable carrying groove 28 accommodating for four connection cables FC. In this case, the first slit 33*a* of the fourth terminal 3*d* is used for electrically connecting with the connection cable FC.

Moreover, connection cavities 29 are formed on the cable carrying groove 28 provided on the upper surface 25 of the housing 2 as shown in FIG. 1(*d*), (*g*) and (*h*). As the connection cavities 29 are formed at the locations of the terminal 3, where the connection cables FC laid in the cable carrying grooves 28 are desired to be connected respectively, the slits 33, which serve as the connection points 34 of the terminal 3, are located at said connection cavities 29 and are exposed in such a way as to allow the connection cables FC to be inserted within the slits 33. In other words, the first terminal 3*a* shown in FIG. 1(*g*) can connect with the connection cable FC laid in the cable carrying groove 28*a* and the fourth terminal 3*d* shown in FIG. 1(*h*) can connect with the connection cable FC laid in the cable carrying groove 28*d* in this embodiment. It goes without saying that it is possible to change the particular connection cable FC to be connection with each terminal 3 by forming the connection cavities 29 by appropriately selection the desired cable carrying grooves 28.

The housing cover 4 includes a cover main body 41 and legs 44 as shown in FIG. 3. The cover main body 41 is a plate-like member with a size approximately equal to the top surface 25 of the housing 2 and is capable of covering the top surface 25 of the housing 2. Insulation displacement connection (IDC) protrusions 43 are formed on the back surface 42 of the cover main body 41 at locations that face the connection cavities 29 when the housing cover 4 is placed over the top surface 25 of the housing 2. A center slit 43*a* is formed on each IDC protrusions 43 as shown in FIG. 3(*a*). A connection point 34 of the terminal 3 is inserted into the slit 43*a* when the housing cover 4 is mounted on the housing 2. Therefore, the IDC protrusions 43 are arranged in a diagonal direction as shown in FIG. 3(*b*), they are generally positioned in accordance with the pattern of the connection cavities 29 provided on the housing 2. Moreover, cable grooves 42*a* similar to cable carrying grooves 28 are provided on the back surface 42 of the housing cover 4 at locations that face the cable carrying grooves 28 of the housing 2 when housing cover 4 is placed to cover the top surface 25 of the housing 2. The legs 44 of the housing cover 4 extend from the four corners of the back face 42 of the housing cover 4. A latching cavity 45 is provided on the inside of each leg 44 close to its end. The latching cavity 45 is positioned at a location where it latches with the latching stub 27*b* of the housing 2 when the housing cover 4 is placed to cover the housing 2. The center slit 43*a* provided in the center of the IDC protrusion 43 is provided through the cover 41 extending from the back surface 42 to the front surface of the cover 41.

Therefore, the housing cover 4 formed this way allows the leg 44 to be inserted along the cover latching groove 27*a* as the housing cover 4 is placed over the housing 2, and the latching cavity 45 that is position to face the latching stub 27*b* latches with the latching stub 27*b* when the cover main body 41 abuts the top surface 25 and the housing cover 4 fits with the housing 2. When the housing cover 4 is fitting the housing 2, the cable carrying grooves 28 and the cable grooves 42*a* are facing each other to support the connection cables FC laid on the cable carrying grooves 28 of the housing cover 4. The IDC protrusions 43 press the connection cables FC located on both sides of each connection point 34 until the connection points 34 provided on the terminal 3 are inserted into the slits 43*a* so that the IDC 43 cuts the external skins of the connection cables FC and push the conductors into the slits 33. As the connection cables FC are pressed into the terminal 3 and the housing cover 4 is mounted on the housing 2, it is possible to conduct a visual inspection of whether the connection cables FC are securely installed at the connection points 34 of the terminal 3 after the housing cover 4 is installed as the slits 43*a* are formed through the cover main body 41.

This is a case where a desired electrical connection is achieved between the connection cables FC and the terminal 3 by means of providing the ICD protrusions 43 on the housing cover 4 at locations where the connection cables and the terminal 3 intersect and by causing the ICD protrusions 43 to apply pressure to the connection cables FC laid on the cable carrying surface 25 thus to break their external skins consequently pressing only the conductors into the slits 33 as the housing cover 4 fits into the housing, it is also possible to achieve the same effect by providing the cover main body 41 on which only the cable grooves 42*a* having the same curvature as the external curvatures of the connection cables FC are formed and spacers 46 that protrude from the cover main body 41 like the ICD protrusions 43, when the cover main body 41 is mounted on the housing 2, separate from the cover main body 41. In this case, the spacers 46 are placed in the cable grooves 42*a* of the cover main body 41 at the positions where the desired connection cables FC and the terminal 3 intersect and in between the connection cables FC and the cover main body 41.

Moreover, although the cable groove 42*a* is provided on the cover main body 41 and the spacer 46 is formed so that one end can be inserted into the cable groove 42*a* as shown in FIG. 4 in the above description, it is also possible to form a latching hole on the back surface 42 of the cover main body 41 at a location where the spacer 46 is to be mounted, i.e., at a position that faces an intersection between each connection cable FC and each terminal 3. Then, form a protrusion that can latch with said latching hole on the spacer 46 to cause the spacer 46 to latch with a latching hole of the desired position. Furthermore, it is also possible to keep the back surface 42 of the cover main body 41 as well as the surface of the spacer 46 that faces the cover main body 41 flat, place the spacer 46 on the connection cable FC prior to the latching of the cover main body 41 with the housing 2, and connect the connection cable FC and the terminal 3 by means of latching the cover main body 41 and the housing 2 after the spacer 46 is placed.

When the connector 1 constituted in the various ways described above is used in various applications involving the connections between a plurality of cables combined into a flat shape such as in a flat cable and various electrical components and devices such as a circuit board, it enables us to obtain electrical signals to the contact parts 32 at various desired positions without bending the flat cable FC or replacing the cable positions. This minimizes the burden to and the possibility of breaking the connection cables FC such as flat cables FC. Moreover, it is also possible to install connectors 1, as shown in FIG. 5, at various intermediate locations of a connection cable FC, which is required to run a long distance, without cutting the connection cable FC.

Moreover, it is also possible to constitute the terminal 3 to allow the two connection cables FC to be connected at a perpendicular position to each other by forming the contact part 32 of the terminal 3 in a similar shape as the connection part 31 and maintaining a 90° angle between the connection part 31 and the contact part 32.

Also, while the conductors of the cables are pressed into the slits 33 at the connection points 34 of the terminal 3 in these embodiments, it is also possible to constitute the system in such a way as to peal off the external skin of the connection cables at the points corresponding to the connection cavities 29 and cause the IDC protrusions 43 of the housing cover 4 to press the exposed conductors of the connection cable FC to the connection points to complete the connections. In this case, it is preferable to constitute in such a way that the IDC protrusion 43 is not just projecting, but rather the IDC protrusion 43 is energized outward by a spring force so that it can provide a better electrical connection between the connection cable FC and the connection point 34 when the housing cover 4 is fitted with the housing 2.

Furthermore, although the top surface 25 of the housing 2 is so constituted as to hide the connection points 34 of each terminal 3 inside the top surface 25 of the housing 2 in order to prevent misconnection of the connecting points 34 and the connection cables FC in this embodiment, it is possible, if it is possible to maintain insulation sufficiently from the external skins of the connection cables FC, to provide the connection points in such a way as to connect electrically with by abutting the connection cables FC in a flat arrangement and provide the connection cavities 29 on both sides of 27 and 27, thus exposing all connection point 34, protruding slightly above the cable carrying grooves 28. With such a constitution, electrical connections can be achieved by causing the latching cavities 45 of the housing cover 4 to press the connection cables FC against the connection points 34 at points where the external skins are peeled off in advance.

Obvious changes may be made in the specific embodiments of the invention described herein, such modifications being within the spirit and scope of the invention claimed, it is indicated that all matter contained herein is intended as an illustrative and not as limitations in scope.

What is claimed is:

1. A connector comprising:

a terminal comprising:

at least one connection part adapted to electrically connect to a connection cable;

at least one contact part adapted to electrically connect with another member;

a housing having, internally, the terminal wherein the at least one connection part of the terminal is located on one side of the housing, and the at least one contact part of the terminal is located on the other side of the housing with the at least one contact part being generally perpendicular to the at least one connection part;

a cable carrying surface disposed on a side on which the connection parts of the terminals are located;

wherein a plurality of connection cables are provided to intersect multiple terminals' connection parts that are arranged in a row and each connection cable is electrically connected with desired terminals;

the plurality of connection cables electrically coupled to the at least one contact part via connection with the at least one connection part; and wherein the orientation of the at least one connection part and the at least one contact part of the terminal allow the connection cables to extend generally in parallel with the other member surface connected thereto.

2. A connector comprising:

a terminal comprising:

at least one connection part adapted to electrically connect to a connection cable; and at least one contact part adapted to connect with a circuit board;

a housing having, internally, the terminal wherein the at least one connection part of the terminal is located on one side of the housing, and the at least one contact part of the terminal is located on the other side of the housing;

a parts mounting surface of the circuit board disposed on a side the at least one contact parts are located; and a cable carrying surface disposed on a side the at least one connection part of the terminal is located on a cable carrying surface;

wherein a plurality of connection cables are provided to intersect multiple terminals' connection parts that are arranged in a row and each connection cable is electrically connected with desired terminals;

the plurality of connection cables electrically coupled to the at least one contact part via connection with the at least one connection part; and wherein the orientation of the connection part and contact part of the terminal allow the connection cables to extend generally in parallel with the circuit board surface connected thereto.

3. A connector as claimed in claim 1, wherein the at least one connection part being installed in a row in the housing extend in a direction intersecting the direction of said installation of the terminal, forming a plurality of connection points.

4. A connector as claimed in claim 1, wherein the cable carrying surface is disposed on a side of the housing the at least one connection parts are located;

the cable carrying surface having a cable carrying groove provided in a row along the cable carrying direction; and, further comprising a connection cavity having a concave shape in the cable carrying groove for connecting the connection cable with the at least one connection part, wherein the connection cavity exposes the at least one connection part of the terminal and enables the at least one connection part to connect with the connection cable.

5. A connector as claimed in claim 1 further comprising:

a housing cover latching with the housing to cover the cable carrying surface, and having an insulation displacement connection (IDC) protrusion formed on a side that faces the cable carrying surface at a location where a desired cable and a desired connection part are to be connected, wherein the desired cable is pressed to be connected electrically with the desired connection part when the housing is latched.

6. A connector as claimed in claim 1 further comprising, a housing cover consisting of a cover main body latching to the housing to cover the cable carrying surface of the housing; and a spacer located over the cables at points where desired cables are connected with their respective desired connection parts, wherein the housing cover electrically connects only the desired cables with the desired connection parts by pressure exerted by the spacer when the cover main body is latched with the housing.

7. A connector as claimed in claim 2, wherein the at least one connection part being installed in a row in the housing extend in a direction intersecting the direction of said installation of the terminal, forming a plurality of connection points.

8. A connector as claimed in claim 2, wherein the cable carrying surface is disposed on a side of the housing the at least one connection parts are located;

the cable carrying surface having a cable carrying groove provided in a row along the cable carrying direction; and, further comprising a connection cavity having a concave shape in the cable carrying groove for connecting the connection cable with the at least one connection part, wherein the connection cavity exposes the connection part of the terminal and enables the at least one connection part to connect with the connection cable.

9. A connector as claimed in claim 3, wherein the cable carrying surface is disposed on a side of the housing the at least one connection parts are located;

the cable carrying surface having a cable carrying groove provided in a row along the cable carrying direction; and, further comprising a connection cavity having a concave shape in the cable carrying groove for connecting the connection cable with the at least one connection part, wherein the connection cavity exposes the at least one connection part of the terminal and enables the at least one connection part to connect with the connection cable.

10. A connector as claimed in claim 2 further comprising:

a housing cover latching with the housing to cover the cable carrying surface, and having an insulation displacement connection (DC) protrusion formed on a side that faces the cable carrying surface at a location where a desired cable and a desired connection part are to be connected, wherein the desired cable is pressed to be connected electrically with the desired connection part when the housing is latched.

11. A connector as claimed in claim 3 further comprising:

a housing cover latching with the housing to cover the cable carrying surface, and having an insulation displacement connection (DC) protrusion formed on a side that faces the cable carrying surface at a location where a desired cable and a desired connection part are to be connected, wherein the desired cable is pressed to be connected electrically with the desired connection part when the housing is latched.

12. A connector as claimed in claim 4 further comprising:

a housing cover latching with the housing to cover the cable carrying surface, and having an insulation displacement connection (IDC) protrusion formed on a side that faces the cable carrying surface at a location where a desired cable and a desired connection part are to be connected, wherein the desired cable is pressed to be connected electrically with the desired connection part when the housing is latched.

13. A connector as claimed in claim 2 further comprising, a housing cover consisting of a cover main body latching to the housing to cover the cable carrying surface of the housing; and a spacer located over the cables at points where desired cables are connected with their respective desired connection parts, wherein the housing cover electrically connects only the desired cables with the desired connection parts by pressure exerted by the spacer when the cover main body is latched with the housing.

14. A connector as claimed in claim 3 further comprising, a housing cover consisting of a cover main body latching to the housing to cover the cable carrying surface of the housing; and a spacer located over the cables at points where desired cables are connected with their respective desired connection parts, wherein the housing cover electrically connects only the desired cables with the desired connection parts by pressure exerted by the spacer when the cover main body is latched with the housing.

15. A connector as claimed in claim 4 further comprising, a housing cover consisting of a cover main body latching to the housing to cover the cable carrying surface of the housing; and a spacer located over the cables at points where desired cables are connected with their respective desired connection parts, wherein the housing cover electrically connects only the desired cables with the desired connection parts by pressure exerted by the spacer when the cover main body is latched with the housing.

* * * * *